US011141831B2

(12) United States Patent
Chen

(10) Patent No.: US 11,141,831 B2
(45) Date of Patent: Oct. 12, 2021

(54) GRINDING MACHINE FOR GRINDING NON-HORIZONTAL GRINDING SURFACES

(71) Applicant: X'POLE PRECISION TOOLS INC., Taoyuan (TW)

(72) Inventor: Bach Pangho Chen, Claremont, CA (US)

(73) Assignee: X'POLE PRECISION TOOLS INC., Taoyuan (TW)

( * ) Notice: Subject to any disclaimer, the term of this patent is extended or adjusted under 35 U.S.C. 154(b) by 639 days.

(21) Appl. No.: 16/045,015

(22) Filed: Jul. 25, 2018

(65) Prior Publication Data

US 2020/0030937 A1 Jan. 30, 2020

(51) Int. Cl.

| | |
|---|---|
| ***B24B 7/18*** | (2006.01) |
| ***B24B 23/04*** | (2006.01) |
| ***B24B 29/02*** | (2006.01) |
| ***B24B 49/04*** | (2006.01) |
| ***B24B 49/16*** | (2006.01) |
| ***B24B 27/00*** | (2006.01) |
| *B24B 49/10* | (2006.01) |

(52) U.S. Cl.

CPC ..... *B24B 49/04* (2013.01); *B24B 7/18* (2013.01); *B24B 23/04* (2013.01); *B24B 27/0084* (2013.01); *B24B 29/02* (2013.01); *B24B 49/16* (2013.01); *B24B 49/10* (2013.01)

(58) Field of Classification Search

CPC ..... B24B 7/18; B24B 7/182; B24B 23/00; B24B 23/04; B24B 23/043; B24B 23/046; B24B 27/0084; B24B 29/02; B24D 15/04; B24D 13/14

USPC ..... 451/59, 164, 166, 168, 344, 351, 356, 451/456, 495, 514, 523, 913

See application file for complete search history.

(56) References Cited

U.S. PATENT DOCUMENTS

| | | | | |
|---|---|---|---|---|
| 3,123,947 A * | 3/1964 | Rawley | B24D 15/04 | 451/495 |
| 3,148,487 A * | 9/1964 | Fildes | B24B 23/04 | 451/351 |
| 3,464,166 A * | 9/1969 | Bouvier | B24D 13/14 | 451/548 |

(Continued)

FOREIGN PATENT DOCUMENTS

| | | |
|---|---|---|
| CN | 101743096 A | 6/2010 |
| CN | 103231320 A | 8/2013 |

(Continued)

*Primary Examiner* — Eileen P Morgan

(74) *Attorney, Agent, or Firm* — Muncy, Geissler, Olds & Lowe, P.C.

(57) ABSTRACT

A grinding machine for grinding non-horizontal grinding surfaces comprises a deformation device which is disposed between a grinding power source and a grinding pad driven by the grinding power source. The deformation device includes a set of an offset unit and the deformation members disposed near one end of the grinding pad, wherein the offset units, the first deformation member and the second deformation member define deformation angles. Therefore, one end of the grinding pad is correspondingly fitted to various non-horizontal grinding surfaces independently through the variable angles of the deformation angle, especially for continuous irregular non-horizontal grinding surfaces. Thus, the present invention has excellent grinding effectiveness.

15 Claims, 10 Drawing Sheets

(56) References Cited

U.S. PATENT DOCUMENTS

| | | | | | |
|---|---|---|---|---|---|
| 3,571,986 | A * | 3/1971 | Champayne | B24B 23/046 | 451/344 |
| 5,081,734 | A * | 1/1992 | Sandford | A47L 11/14 | 15/236.1 |
| 5,947,803 | A | 9/1999 | Gruner | | |
| 7,131,902 | B2 * | 11/2006 | Hope | B24D 15/023 | 451/533 |
| 7,553,221 | B2 * | 6/2009 | Hope | B24D 15/023 | 451/495 |
| 7,954,482 | B2 * | 6/2011 | Castonguay | B24B 1/007 | 125/13.01 |
| 8,858,304 | B2 * | 10/2014 | Andonian | B24D 15/023 | 451/495 |
| 9,833,871 | B2 | 12/2017 | Fronek | | |
| 2003/0104774 | A1 * | 6/2003 | Peterson | B28D 1/265 | 451/351 |
| 2009/0124183 | A1 * | 5/2009 | Carballo | B24B 23/043 | 451/356 |
| 2015/0367476 | A1 * | 12/2015 | Fronek | B24D 15/04 | 451/344 |

FOREIGN PATENT DOCUMENTS

| | | | | | |
|---|---|---|---|---|---|
| GB | 680866 | A | | 10/1952 | |
| GB | 1013419 | A | * | 12/1965 | B24D 15/04 |
| JP | H05329762 | A | | 12/1993 | |
| JP | H0811046 | A | | 1/1996 | |
| JP | 2000117609 | A | | 4/2000 | |
| JP | 2001113453 | A | | 4/2001 | |
| JP | 2009233810 | A | | 10/2009 | |

* cited by examiner

GRINDING MACHINE FOR GRINDING NON-HORIZONTAL GRINDING SURFACES

FIELD OF THE INVENTION

The present invention relates to a grinding machine for grinding non-horizontal grinding surfaces, particularly surfaces comprising non-planar or curved portions, and more particularly to a grinding machine comprising a grinding pad which performs a grinding stroke for adapting the continuous irregular non-horizontal grinding surfaces correspondingly.

BACKGROUND OF THE INVENTION

Related techniques for grinding on non-horizontal grinding surfaces such as a concave or convex surface have been disclosed in the patents Chinese Patent No. CN 101743096A, Chinese Patent No. CN 103231320A, U.K. Patent No. GB 680866A, Japanese Patent No. JP H05329762A, Japanese Patent No. JP H0811046A, Japanese Patent No. JP 2000-117609A, Japanese Patent No. JP 2001-113453A, Japanese Patent No. JP 2009-233810A, U.S. Pat. Nos. 5,947,803, 9,833,871, etc.

To sum up the grinding machines for grinding non-horizontal grinding surfaces disclosed in the above patents, a driving unit of the grinding machine is connected to a receiving plate, and the receiving plate and a grinding pad are connected with a deforming member. In an initial state or when a grinding surface is horizontal, the grinding pad and the receiving plate are horizontal and the deforming member is not deformed. When the user grinds the non-horizontal grinding surface, the deforming member is deformed and relatively offset based on the center line of the grinding pad, allowing the two ends of the grinding pad being deformed along the radian of the non-horizontal grinding surface to fit to the non-horizontal grinding surface.

Whether the deforming members of the above patents adopt a lever shaft connection method or a design of an elastic element such as a spring, they comprise only a single deformed state between the grinding pad and the receiving plate, limiting the deformation degree of the deforming members. Therefore, when grinding a non-horizontal grinding surfaces with a large radian, it is practically impossible to fit to the grinding surface and the grinding efficiency is reduced. Besides, in the conventional lever shaft connection method, such as U.S. Pat. No. 9,833,871, the deforming members on both sides must simultaneously deform to maintain a horizontal state between the receiving plate and the grinding pad. However, in practice, the non-horizontal grinding surface cannot provide the same radian corresponding to both ends of the grinding pad, especially in a continuous uneven wave-like non-horizontal grinding surface. This type of grinding machine will not be able to effectively conform to the changes of the non-horizontal grinding surface to perform grinding operations.

SUMMARY OF THE INVENTION

A primary object of the present invention is to solve the problem in the conventional techniques being unable to effectively fit to continuous irregular non-horizontal grinding surfaces correspondingly to perform grinding strokes.

Thus it is a particular problem to be solved by the present invention to provide an enhanced grinding machine for grinding non-horizontal grinding surfaces configured to adapt the shape of the grinding pad better to the shape of the continuous irregular non-horizontal grinding surfaces with a simple and cost-efficient mechanical setup.

These problems are solved by a grinding machine for grinding non-horizontal grinding surfaces as claimed by claim 1. Further advantageous embodiments are the subject-matter of the dependent claims.

In order to achieve the above object, the present invention provides a grinding machine for grinding non-horizontal grinding surfaces, particularly surfaces non-planar or (convexly and/or concavely) curved portions, comprising a deformation device is disposed between a grinding power source and a grinding pad driven by the grinding power source. The deformation device comprises at least one receiving unit for holding the grinding power source. Besides, the receiving unit defines a reference horizontal line. The deformation device comprises a set of an offset unit, a first deformation member and a second deformation member disposed near one end of the grinding pad, wherein the offset units, the first deformation member and the second deformation member define a first deformation angle and a second deformation angle. Therefore, one end of the grinding pad is fitted to various non-horizontal grinding surfaces, especially continuous irregular non-horizontal grinding surfaces, independently through the variable angles of one of the first and the second deformation angles or the combination of the both. Furthermore, the receiving unit of the present invention maintains the reference horizontal line during the grinding operation and provides excellent grinding effectiveness.

In one embodiment, the two second deformation members and the first deformation member disposed at a central position of the two second deformation members assist the grinding pad to generate a deformed state in response to the non-horizontal grinding surface.

In one embodiment, the two sets of the second deformation members respectively disposed at four ends of the offset unit and the two first deformation members disposed at the central position of the second deformation members assist the grinding pad to generate a deformed state in response to the non-horizontal grinding surface.

In one embodiment, the grinding power source is manual, and the receiving unit comprises an outer housing to assist in applying an external force. And, the receiving unit further comprises a covering portion extended to the grinding pad and including an opening for connecting an external dust remover.

In one embodiment, the grinding power source is a power grinding machine of one of an electric grinder or a pneumatic grinder, and the power grinding machine includes a power shaft connected to the grinding pad for carrying out grinding strokes.

According to the foregoing disclosure of the present invention, it has the following features compared with the conventional techniques: either end of the grinding pad is correspondingly fitted to various non-horizontal grinding surfaces independently through the variable angles of the deformation angle, especially for continuous irregular non-horizontal grinding surfaces. Thus, the present invention has an excellent grinding effectiveness.

DETAILED DESCRIPTION OF THE PREFERRED EMBODIMENTS

Figure 1:
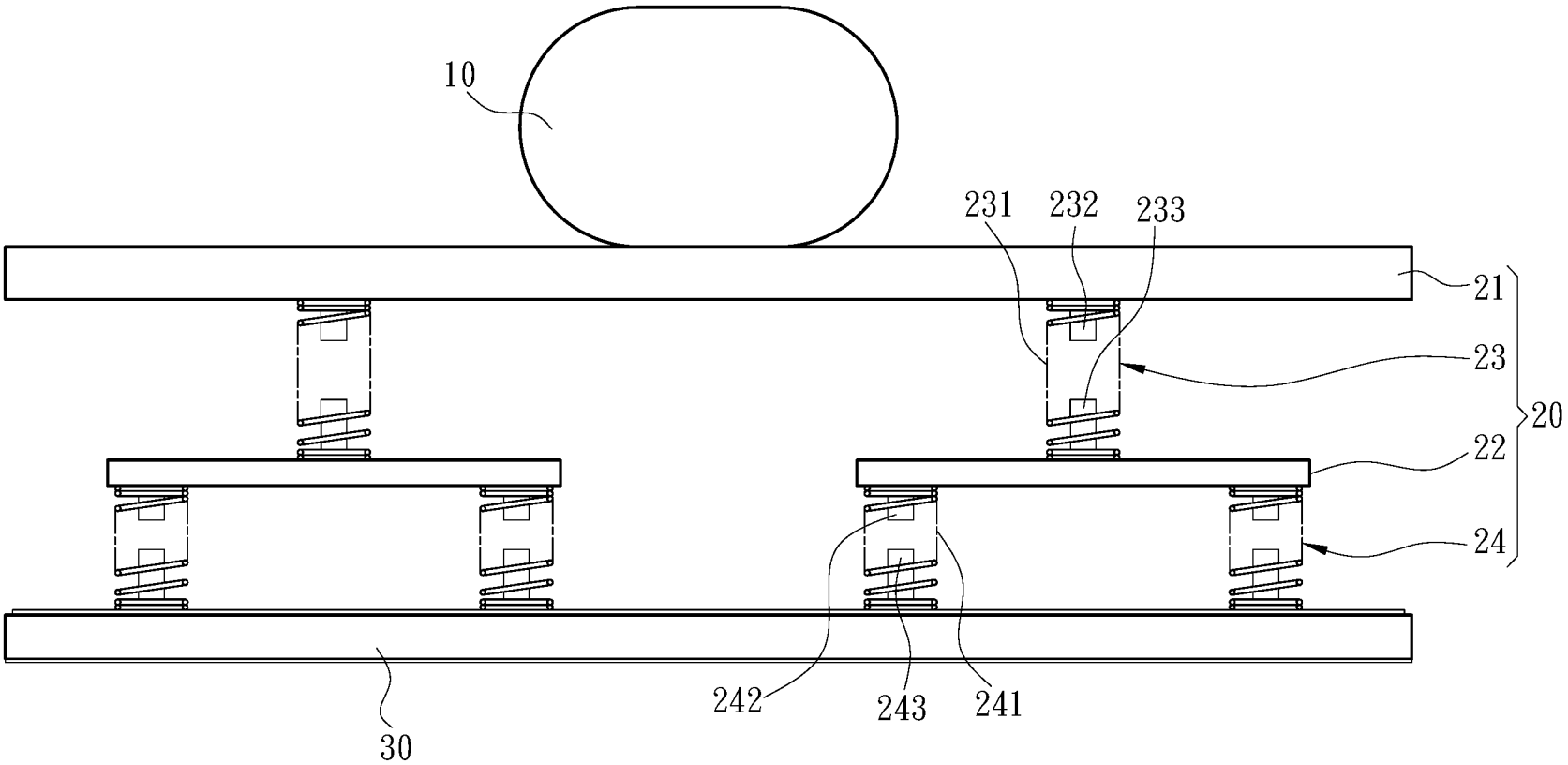
FIG. 1 is a cross-sectional view of an initial state according to an embodiment of the present invention.
Figure 2:
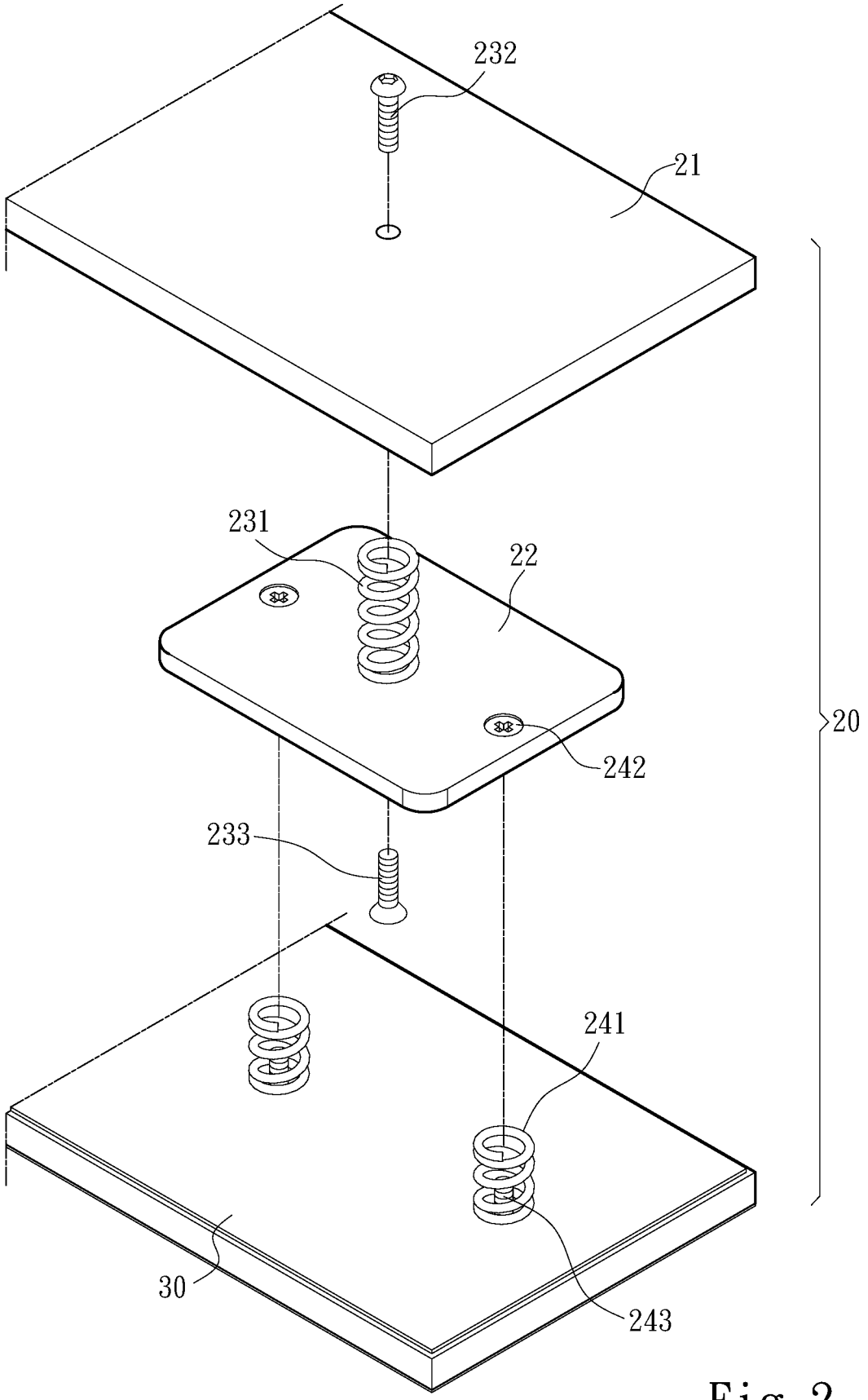
FIG. 2 is an exploded view of a deformation device according to an embodiment of the present invention.

The detailed description and technical content of the present invention will be described as follows in conjunction with the drawings:

Referring to FIG. 1 and FIG. 2, the present invention provides a grinding machine for grinding non-horizontal grinding surfaces, comprising a grinding power source 10 and a grinding pad 30 driven by the grinding power source 10 to perform a grinding stroke on a non-horizontal grinding surface. The grinding pad 30 is made of an elastic material and configured to take a deformed state for adapting the shape of the grinding pad 30 to the shape or profile of the non-horizontal grinding surface. The grinding pad 30 includes a flexible metal layer at the top, a compression layer made of a flexible material such as rubber or sponge in the middle, and a deformable soft grinding layer at the bottom. The grinding pad 30 with a deformed state generally is known from the a prior art and has various implementation forms. That is, other embodied forms of the grinding pad 30 will not be described again because they do not belong to the technical limitations of the specification.

According to the present invention, a deformation device 20 is disposed between the grinding power source 10 and the grinding pad 30. The deformation device 20 comprises at least one receiving unit 21 for holding the grinding power source 10, and two offset units 22 disposed between the grinding pad 30 and the receiving unit 21. Besides, the receiving unit 21 defines a reference horizontal line and the two offset units 22 are respectively disposed near two opposite ends of the receiving unit 21. Furthermore, the deformation device 20 comprises at least one first deformation member 23 connected between each of the offset units 22 and the receiving unit 21, and at least two second deformation members 24 disposed oppositely and connected between each of the offset units 22 and the grinding pad 30. Therefore, when the grinding pad 30 performs the grinding stroke on the non-horizontal grinding surface to generate the deformed state, the at least one first deformation member 23 is deformed independently to define a first deformation angle R1 formed between anyone of the offset units 22 and the reference horizontal line of the receiving unit 21, and at least two second deformation members 24 are deformed to define a second deformation angle R2 is formed between the grinding pad 30 and the reference horizontal line of the receiving unit 21. Referring to FIG. 1, the at least two second deformation members 24 and the at least one first deformation member 23 are arranged in a staggered configuration. The at least one first deformation member 23 comprises fixing segments 232, 233 at two ends and a central deforming segment 232. Each of the at least two second deformation members 24 comprises fixing segments 242, 243 at both two ends and a central deforming segment 241. The fixing segments 232, 233 of the first deformation member 23 are respectively connected to the receiving unit 21 and the offset units 22, and the fixing segments 242, 243 of the second deformation members 24 are respectively connected to the offset units 22 and the grinding pad 30. Moreover, the first deformation member 23 and the second deformation member 24 are one of a spring, a spring piece or rubber.

In order to facilitate the understanding of the deformation actuation state of the present invention, an embodiment according to the present invention will be described with the spring as the first deformation member 23 and the second deformation member 24. Please refer to FIG. 1 and FIG. 2, in the initial state or when the user performs the grinding operation of the horizontal grinding surface, the receiving unit 21 and the grinding pad 30 are relatively horizontal, and the offset units 22 and the receiving unit 21 is also relatively horizontal.

Figure 3A:
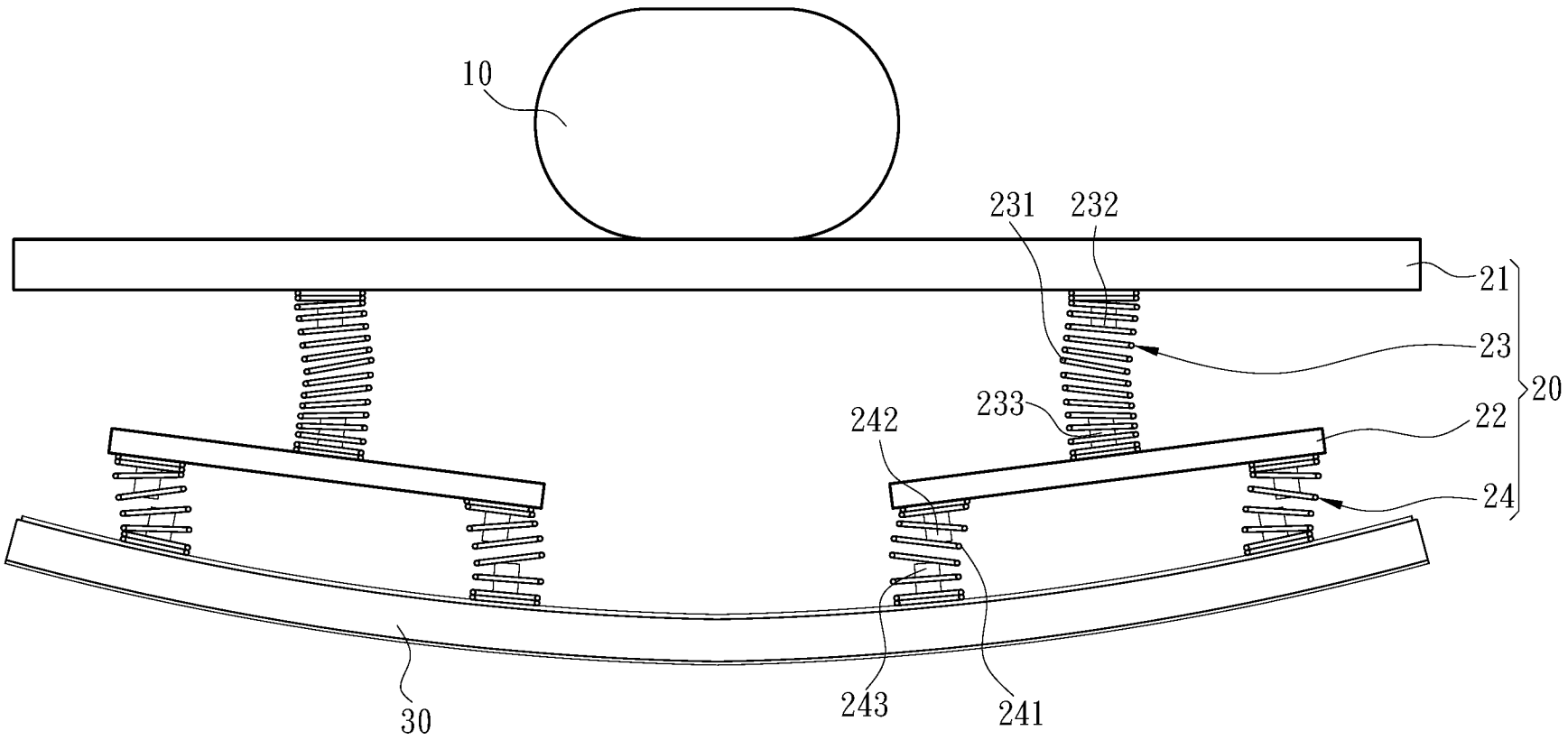
FIG. 3A and FIG. 3B are schematic views showing a deformed state corresponding to a non-horizontal grinding surface as a concave surface according to an embodiment of the present invention.
Figure 3B:
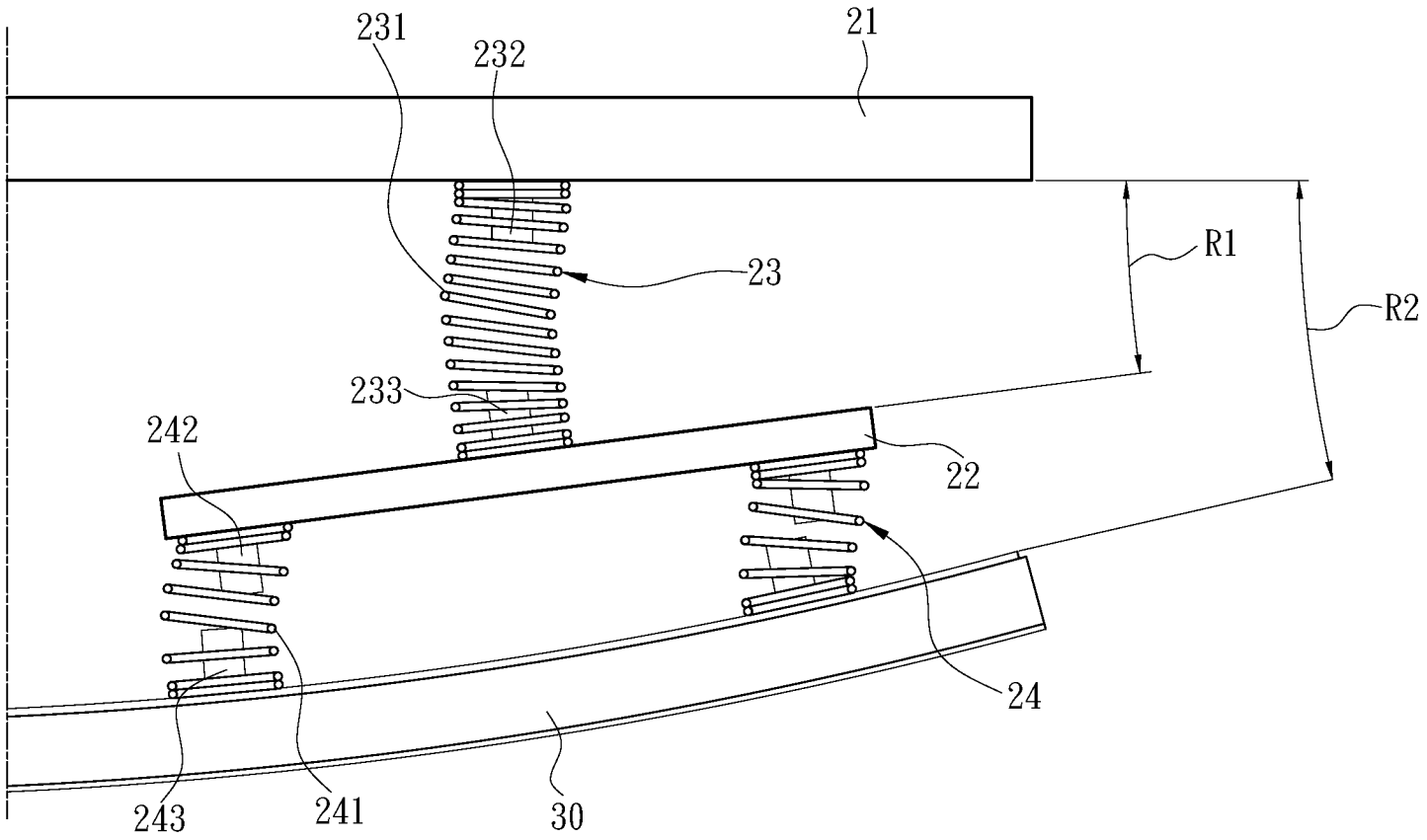

Please refer to FIG. 3A and FIG. 3B, which are schematic views of the deformed states of the present invention when grinding a concave surface. When the grinding power source 10 applies a force to the receiving unit 21 when operated by the user to grind a concave surface, the force applied by the grinding power source 10 and the feedback force generated from two ends of the grinding pad 30 cause the deformation of the central deforming segments 231, 241 of the first deformation member 23 and the second deformation members 24. Thus, the grinding pad 30 is deformed into the deformed state in which that the surface of the grinding pad 30 is fitted to the radian of the curved surface. The deformation forms of the central deforming segments 231 and 241 vary according to different materials, including but not limited to the forms of one or a combination of compression or bending of the central deforming segments 231 and 241. Then, when the central deforming segment 231 of the first deformation member 23 is deformed, a first deformation angle R1 is formed between the reference horizontal line of the receiving unit 21 and the offset unit 22 since the fixing segments 232 and 233 of the first deformation member 23 is respectively connected to the receiving unit 21 and the offset units 22. Meanwhile, a second deformation angle R2 is formed between the grinding pad 30 and the reference horizontal line when the second deformation members 24 are deformed. Accordingly, the relative variations of the first deformation angle R1 and the second deformation angle R2 constitute the deformed state of the grinding pad 30, so that the grinding pad 30 effectively fits to the curved surface as shown in FIG. 3A.

Figure 4A:
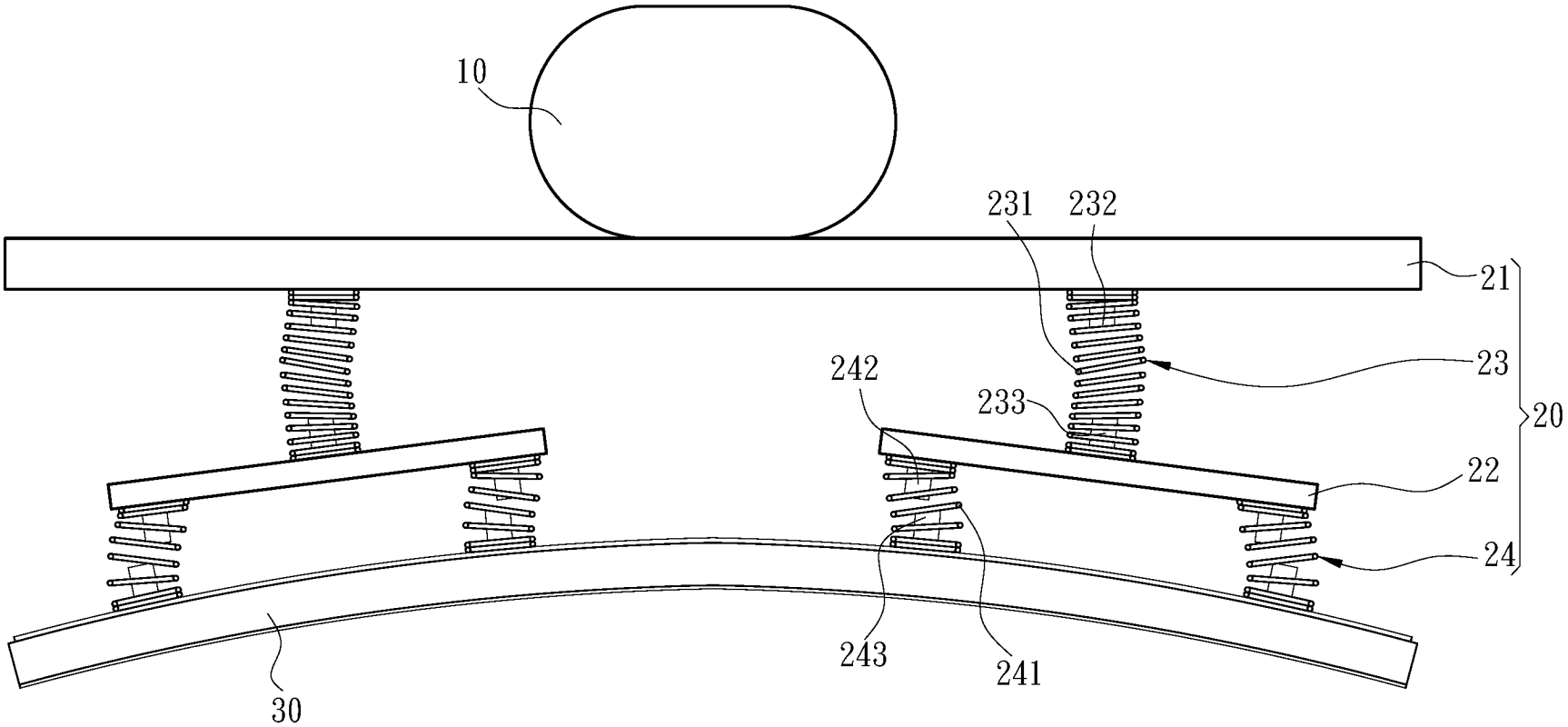
FIG. 4A and FIG. 4B are schematic views showing a deformed state corresponding to a non-horizontal grinding surface as a convex surface according to an embodiment of the present invention.
Figure 4B:
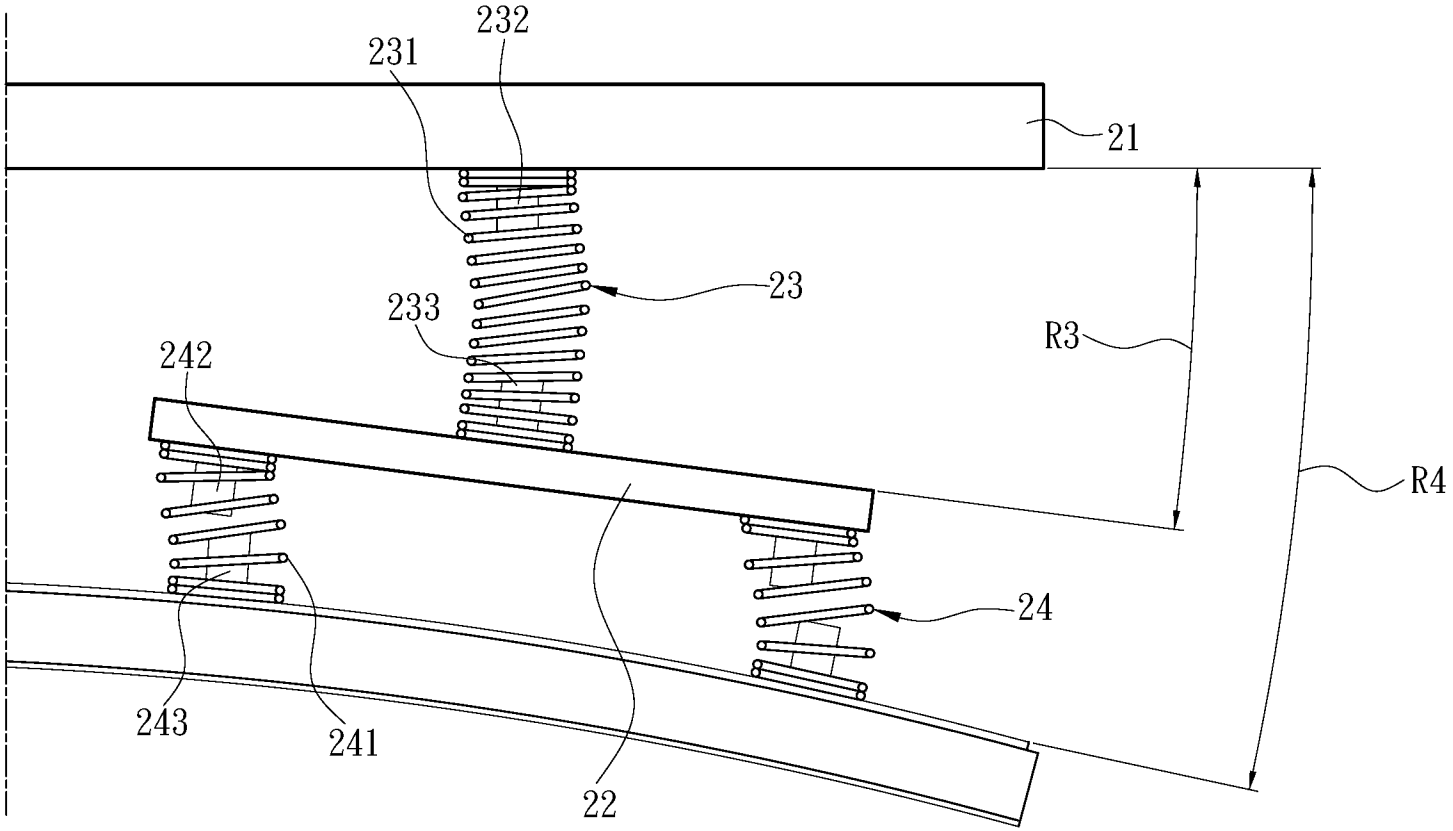

Similarly, please refer to FIG. 4A and FIG. 4B, which are schematic views of the deformed states of the present invention when grinding a convex surface. The second deformation members 24 are deformed to define a second deformation angle R4 formed between the grinding pad 30 and the reference horizontal line of the receiving unit 21, and the first deformation members 23 is deformed to define a first deformation angle R3 formed between the offset unit 22 and the reference horizontal line of the receiving unit 21. The relative variations of the first deformation angle R3 and the second deformation angle R4 constitute the deformed state of the grinding pad 30, so that the grinding pad 30 effectively fits to the convex surface as shown in FIG. 4A.

Figure 5:
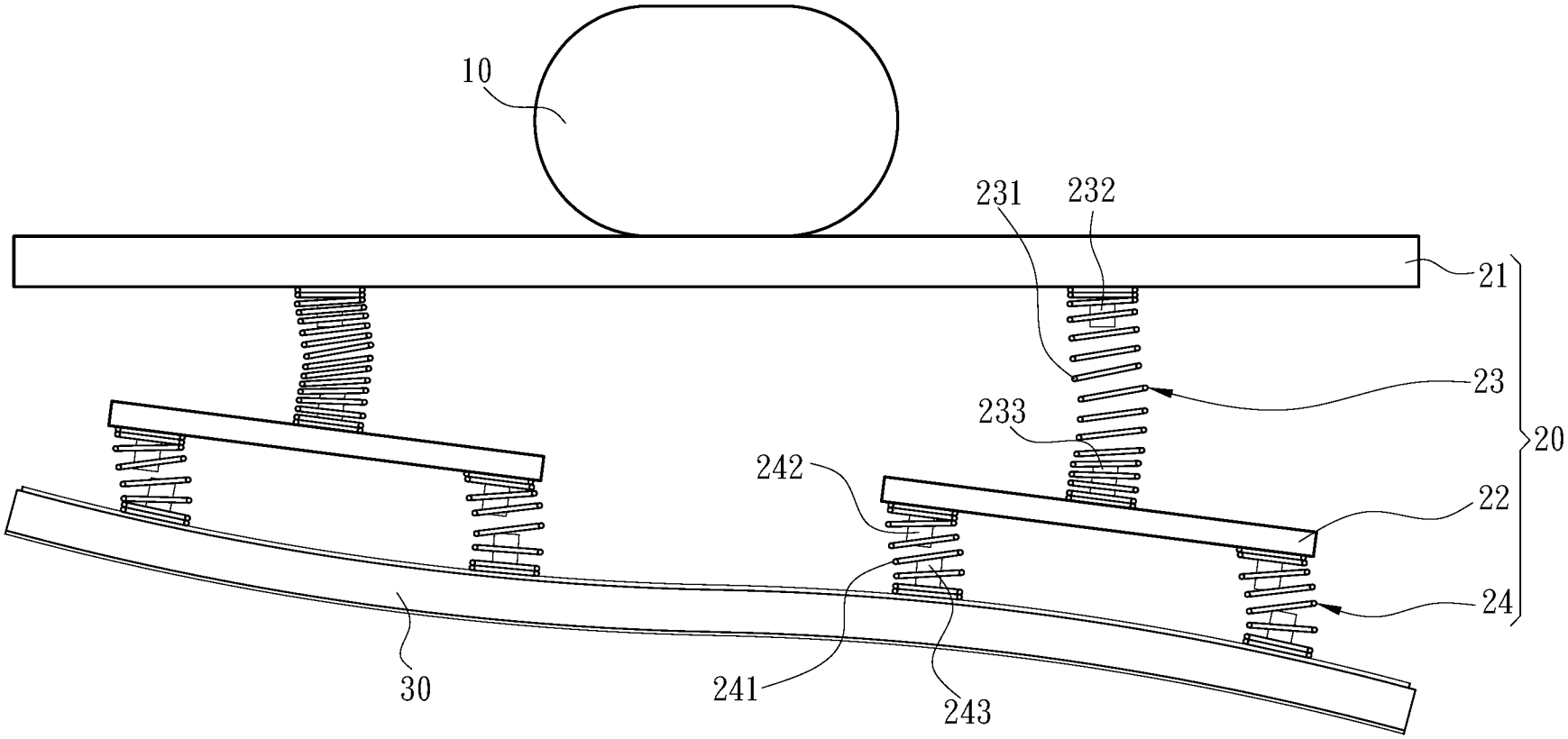
FIG. 5 is a schematic view showing a deformed state corresponding to a non-horizontal grinding surface as a concave-convex surface according to an embodiment of the present invention.

Referring to FIG. 5, when the curve position of the grinding pad 30 is changed during the grinding strokes, the deformation variables of the first deformation members 23 and the second deformation members 24 would be changed accordingly. Besides, in order to fit to different curved or convex surfaces, one or the combination of the first deformation angles R1, R3 and the second deformation angles R2, R4 would be changed accordingly.

Moreover, since two sets of the offset units 22, the first deformation members 23 and the second deformation members 24 are independently disposed near two opposite ends of the grinding pad 30, each end of the grinding pad 30 is able to independently fit to the non-horizontal grinding surface based on the variable angles of the first deformation angles R1, R3 and the second deformation angles R2, R4. This is important for an irregular and continuous non-horizontal grinding surface as shown in FIG. 5, when grinding a surface comprises both convex and curved surfaces simultaneously, the grinding pad 30 of the present invention is independently deformed at two ends without interlinking each other, so that the grinding pad 30 includes different radians at two ends in the deformed state to keep fitting to the grinding surface. As shown in FIG. 5, the grinding surface of one end of the grinding pad 30 is in a convex-deformed state, and the grinding surface of another end of the grinding pad 30 is in a concave-deformed state. Therefore, the grinding pad 30 of the present invention maintains the independent deformed state of each end of the grinding pad 30 to fit to the grinding surface for effectively performing the grinding strokes.

Figure 6:
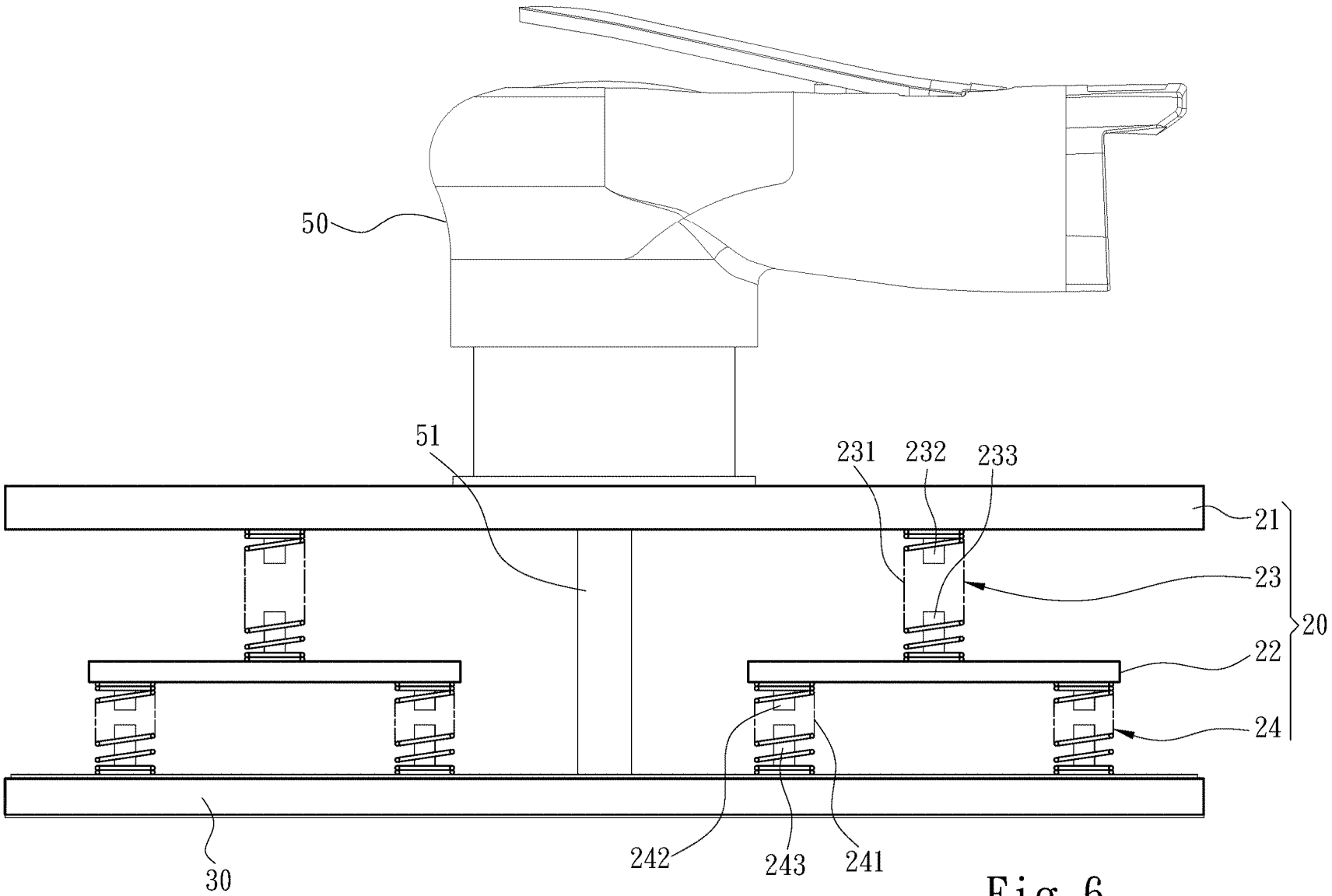
FIG. 6 is a cross-sectional view of an embodiment of the present invention applied to a power grinding machine.

Please refer to FIG. 6, the grinding power source 50 of the present invention is configured for use in a power grinding machine of an electric grinder or of a pneumatic grinder. The power grinding machine includes a power shaft 51 connected to the grinding pad 30, and the power grinding machine is used as the grinding power source 50 to drive the grinding pad 30 with the power shaft 51 to perform grinding strokes of linear or eccentric track.

Figure 7:
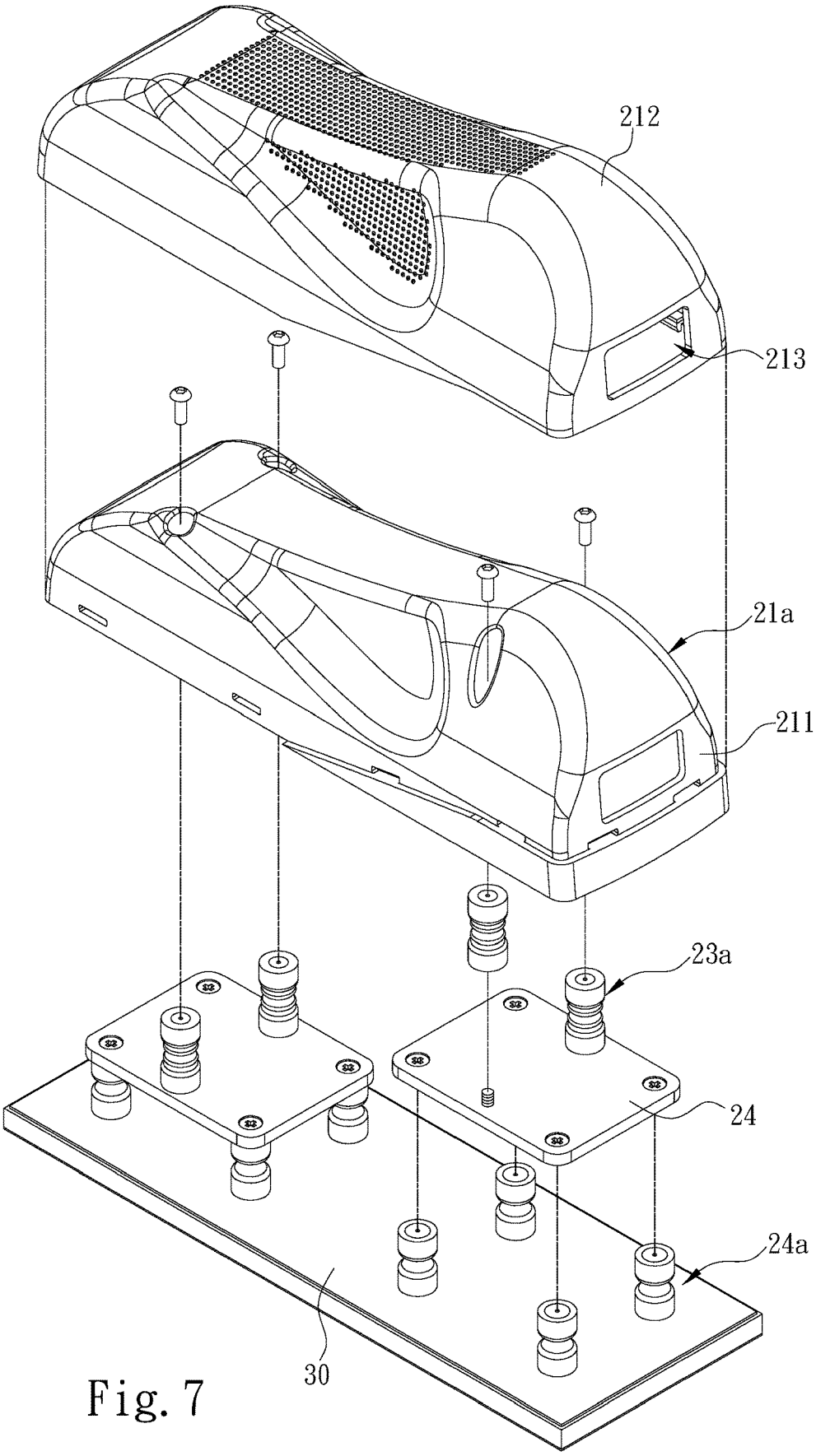
FIG. 7 is an exploded view of an embodiment of the present invention applied to a manual grinding machine.
Figure 8:
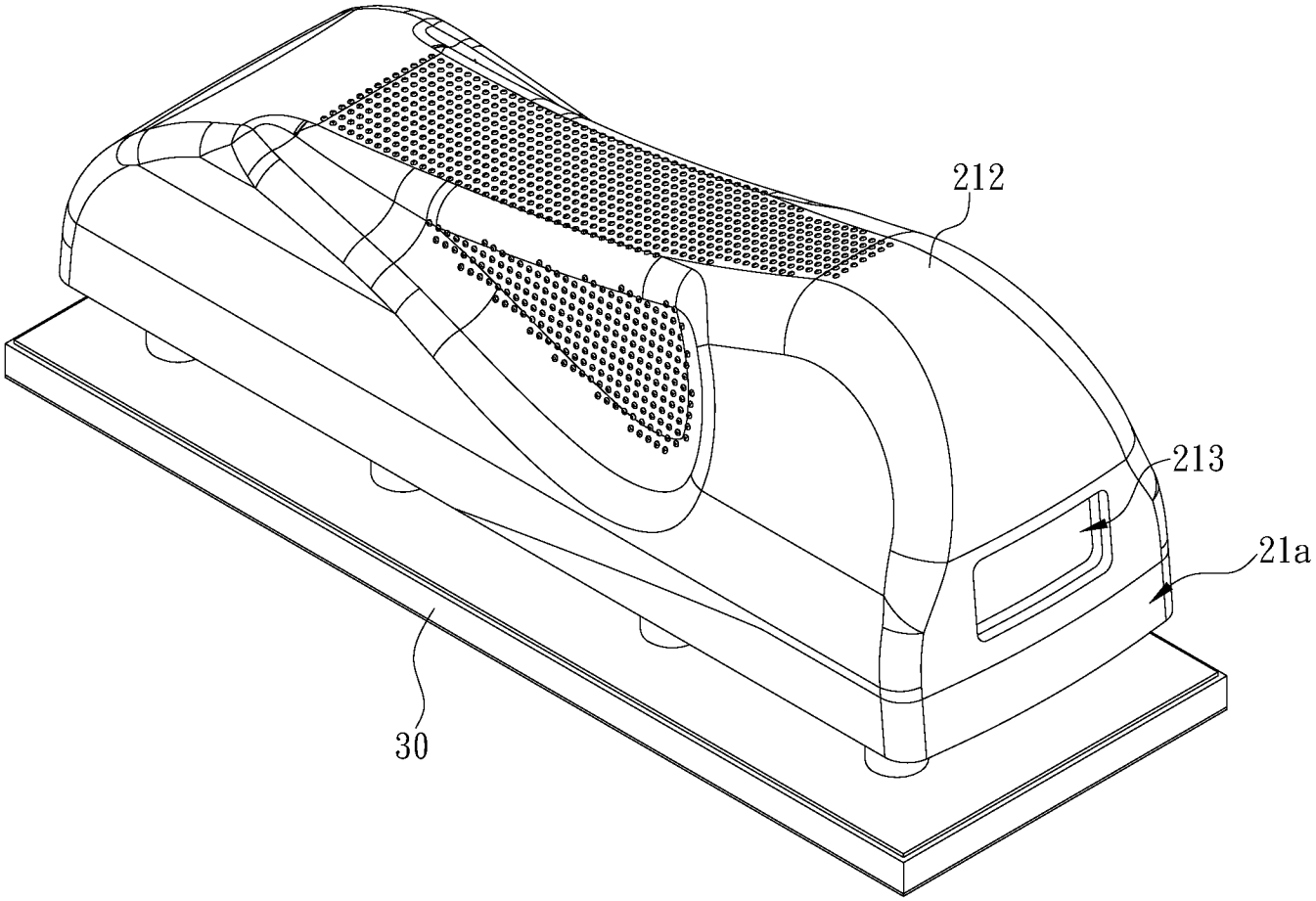
FIG. 8 is a perspective view of an embodiment of the present invention applied to a manual grinding machine.

Please refer to FIG. 7 and FIG. 8, the grinding pad 30 of the present invention is mainly of a rectangular shape, and the number of disposing sets of a first deformation members 23*a* and a second deformation members 24*a* are based on the different sizes of the grinding pad 30. For example, if the grinding pad 30 is larger in size, it requires a finer and more stable deformation balance during the grinding strokes. At this point, the first deformation members 23*a* are more than two disposed, the first deformation members 23*a* are preferably disposed in two sets, and the two sets of the second deformation members 24*a* are disposed at the four end points of the offset unit 22. Each of the first deformation members 23*a* is preferably maintained to be arranged on a vertical line at a central position of the two second deformation members 24*a* in a staggered manner. In addition, depending on the deformed state required for different grinding surfaces, the deformation variable of the central deforming segment 231 of the first deformation members 23*a* of the present invention is greater than or equal to the deformation variable of the central deforming segment 241 of the second deformation members 24*a*.

In order to facilitate the implementation of operation of the present invention, the shape of the receiving unit 21 basically corresponds the rectangular shape of the grinding pad 30. The grinding power source 10 is configured to be disposed at the central position or the at positions on the two sides of the grinding pad 30 depending on the size of the grinding pad 30. Referring to FIG. 8, which further discloses a receiving unit 21*a* comprising a covering portion 211 extending to the grinding pad 30, and an outer portion of the receiving unit 21*a* further comprises an outer housing 212 covering the receiving unit 21*a* and the covering portion 211 to assist in applying an external force. The covering portion 211 and the outer housing 212 further include an opening 213 to connect an external dust remover (not shown) for removing the internal dust while the grinding pad 30 is performing the grinding strokes.

To summarize the above, through the mounting of the deformation device 20 between the grinding power sources 10, 50 and the grinding pad 30 of the present invention, and because a set of the offset units 22 is provided, the first deformation members 23, 23*a* and the second deformation members 24, 24*a* are independently disposed between either side of the grinding pad 30 and the receiving units 21, 21*a*, either side of the grinding pad 30 independently forms the variable angles of the first deformation angle R1 and the second deformation angle R2 to correspondingly fit to various non-horizontal grinding surfaces, especially for continuous irregular non-horizontal grinding surfaces. The present invention has excellent grinding effectiveness compared with the conventional techniques.

What is claimed is:

1. A grinding machine for grinding non-horizontal grinding surfaces, comprising: a grinding power source and a grinding pad driven by the grinding power source to perform a grinding stroke on a non-horizontal grinding surface, the grinding pad being made of an elastic material and being configured to take a deformed state for adapting to the non-horizontal grinding surface; and a deformation device disposed between the grinding power source and the grinding pad, the deformation device comprising at least one receiving unit for holding the grinding power source, and two offset units disposed between the grinding pad and the receiving unit, wherein the receiving unit defines a reference horizontal line, and the two offset units are respectively disposed near two opposite ends of the receiving unit, wherein each of the two offset units is provided with at least one first deformation member connected between each offset units and the receiving unit, and each offset unit having at least two second deformation members disposed oppositely of each first deformation member and connected between each offset unit and the grinding pad; wherein when the grinding pad performs the grinding stroke on the non-horizontal grinding surface to generate the deformed state, the at least one first deformation member of either of the two offset units is deformed independently to define a first deformation angle formed between the respective offset unit and the reference horizontal line of the receiving unit, and one of the at least two second deformation members of either of the two offset units is deformed to define a second deformation angle formed between the grinding pad and the reference horizontal line of the receiving unit.

2. The grinding machine for grinding non-horizontal grinding surfaces according to claim 1, wherein the at least one first deformation member of each of the two offset units is disposed at a central position corresponding to the at least two second deformation members of each of the two offset units.

3. The grinding machine for grinding non-horizontal grinding surfaces according to claim 1, wherein each of the two offset units comprises two sets of the at least two second deformation members.

4. The grinding machine for grinding non-horizontal grinding surfaces according to claim 3, wherein each of the at least two second deformation members of the two sets are disposed at respective four end points of each of the two offset units respectively.

5. The grinding machine for grinding non-horizontal grinding surfaces according to claim 4, wherein each of the two offset units comprises two first deformation members disposed between the respective offset unit and the receiving unit.

6. The grinding machine for grinding non-horizontal grinding surfaces according to claim 5, wherein each of the two first deformation members of each offset unit is disposed at a central position corresponding to the at least two second deformation members of one of the two sets of each offset unit.

7. The grinding machine for grinding non-horizontal grinding surfaces according to claim 1, wherein each of the at least one first deformation member of each of the two offset units comprises two opposing first fixing segments at two opposing ends of each of the first deformation member to connect the respective receiving unit and the respective offset unit, and each of the at least one first deformation member of each of the two offset units comprises a first central deforming segment between the two first fixing segments, and each of the at least two second deformation members of each of the two offset units comprises two opposing second fixing segments at two opposing ends of each second deformation member to connect the respective grinding pad and the respective offset unit, wherein each of the at least two second deformation members of each of the two offset units comprises a second central deforming segment between the two second fixing segments.

8. The grinding machine for grinding non-horizontal grinding surfaces according to claim 7, wherein a deformation variable of one of the first central deforming segments of the at least first deformation member of each of the two offset units is greater than or equal to a deformation variable of one of the second central deforming segments of the at least two second deformation members of each of the two offset units.

9. The grinding machine for grinding non-horizontal grinding surfaces according to claim 1, wherein the shape of the receiving unit is equivalent to or corresponds to the shape of the grinding pad.

10. The grinding machine for grinding non-horizontal grinding surfaces according to claim 9, wherein the receiving unit further comprises a covering portion extending to the grinding pad.

11. The grinding machine for grinding non-horizontal grinding surfaces according to claim 10, wherein the covering portion comprises an opening for connecting an external dust remover.

12. The grinding machine for grinding non-horizontal grinding surfaces according to claim 1, wherein the grinding power source manually applies an external force directly to the receiving unit.

13. The grinding machine for grinding non-horizontal grinding surfaces according to claim 12, wherein the receiving unit further comprises an outer housing to assist in providing force.

14. The grinding machine for grinding non-horizontal grinding surfaces according to claim 1, wherein the grinding power source is a power grinding machine and the power grinding machine comprises a power shaft connected to the grinding pad.

15. The grinding machine for grinding non-horizontal grinding surfaces as claimed in claim 14, wherein the power grinding machine is an electric grinder or a pneumatic grinder.

* * * * *